US011077453B2

(12) United States Patent
Nölle

(10) Patent No.: US 11,077,453 B2
(45) Date of Patent: Aug. 3, 2021

(54) HIGH-PRESSURE ROTOR NOZZLE

(71) Applicant: HAMMELMANN GMBH, Oelde (DE)

(72) Inventor: René Nölle, Oelde (DE)

(73) Assignee: HAMMELMANN GMBH, Oelde (DE)

( * ) Notice: Subject to any disclaimer, the term of this patent is extended or adjusted under 35 U.S.C. 154(b) by 196 days.

(21) Appl. No.: 16/082,082

(22) PCT Filed: Apr. 5, 2017

(86) PCT No.: PCT/EP2017/058052
§ 371 (c)(1),
(2) Date: Sep. 4, 2018

(87) PCT Pub. No.: WO2017/174622
PCT Pub. Date: Oct. 12, 2017

(65) Prior Publication Data

US 2020/0222924 A1 Jul. 16, 2020

(30) Foreign Application Priority Data

Apr. 7, 2016 (DE) ..... 102016106376.2

(51) Int. Cl.
*B05B 3/06* (2006.01)
*B05B 3/00* (2006.01)

(52) U.S. Cl.
CPC ..... *B05B 3/06* (2013.01); *B05B 3/002* (2013.01); *B05B 3/003* (2013.01)

(58) Field of Classification Search
CPC ..... B05B 3/06; B05B 3/002; B05B 3/003; B05B 3/0427; B05B 3/00; B05B 3/063; B05B 3/066

(Continued)

(56) References Cited

U.S. PATENT DOCUMENTS 4,821,961 A 4/1989 Shook
5,141,158 A 8/1992 Allen
(Continued)

FOREIGN PATENT DOCUMENTS

DE 202008002597 4/2008
EP 1163959 12/2001
EP 2508266 10/2012

OTHER PUBLICATIONS

Int'l Search Report issued in App. No. PCT/EP2017/058052 (dated 2017).

*Primary Examiner* — Qingzhang Zhou
*Assistant Examiner* — Joel Zhou
(74) *Attorney, Agent, or Firm* — Barnes & Thornburg LLP

(57) ABSTRACT

The invention relates to a high-pressure rotor nozzle comprising a main body having a channel for supplying a highly pressurised fluid, a nozzle holder which can be rotationally driven for this purpose via a hydraulically generated torque, and which has at least one nozzle connected to the channel in a manner open for fluid and acting in accordance with an axial recoil, wherein a leakage chamber forming a hydraulic axial bearing during operation is provided between the main body and the nozzle holder that can be axially adjusted in relation to same in a recoil-dependent manner, with said leakage chamber being connected to a first gap seal between the main body and the nozzle holder guiding a leakage fluid, wherein the high-pressure rotor nozzle is designed in such a way that the leakage chamber transitions into at least one throttle gap circumferentially surrounding the nozzle holder in an axial sub-region and varying in the axial extension thereof according to the movement path of the nozzle holder, wherein the throttle gap remains the same height over the axial length thereof.

14 Claims, 3 Drawing Sheets

(58) Field of Classification Search
USPC ..... 239/252, 261, 246
See application file for complete search history.

(56) References Cited

U.S. PATENT DOCUMENTS

| | | | | |
|---|---|---|---|---|
| 5,147,189 | A * | 9/1992 | Barnowski | F04B 53/166 417/567 |
| 6,027,040 | A * | 2/2000 | Frye-Hammelmann | B05B 3/006 239/252 |
| 8,434,696 | B2 | 5/2013 | Wright et al. | |
| 2006/0124362 | A1* | 6/2006 | Kolle | E21B 10/60 175/67 |
| 2011/0036376 | A1 | 2/2011 | Wojciechowski, III et al. | |
| 2011/0108636 | A1 | 5/2011 | Wright | |

* cited by examiner

HIGH-PRESSURE ROTOR NOZZLE

CROSS-REFERENCE TO RELATED APPLICATION

This application claim benefit under 35 U.S.C. § 119 and is a U.S. nationalization of International Application No. PCT/EP2017/058052, filed on Apr. 5, 2017, which claims priority from German Patent Application No. 10 2016 106 376.2, filed on Apr. 7, 2016, and incorporates by reference the disclosures thereof in their entireties.

BACKGROUND AND SUMMARY OF THE DISCLOSURE

The present disclosure relates to a high-pressure rotor nozzle.

Such a high-pressure rotor nozzle is used, for example, for removing dirt adhering to surfaces, in particular on inner and outer surfaces of pipes, containers or the like, with a fluid pressure of up to 4,000 bar.

The high-pressure rotor nozzle has a nozzle holder which is rotatably mounted about an axis and which can be driven by the recoil of the pressurized water emerging from the nozzle of the nozzle holder.

The nozzle holder is mounted in a main body, which has a central, axially aligned channel, which communicates with the nozzles for supplying the pressurized fluid.

Between the main body and the nozzle holder a plurality of gap seals is arranged, and a leakage chamber which forms an axial bearing for receiving recoil forces occurring during operation of the rotor nozzle, wherein both the gap seals as well as the leakage chamber are fed with leakage water and the leakage chamber communicates via a leakage discharge with the atmosphere.

A known rotor nozzle is disclosed in U.S. Pat. No. 8,434,696B2. There, at least one of the gap seals between the nozzle holder and the main body is tapered conically against the direction of the recoil force, so that the height of the gap seal increases with increasing recoil force, resulting in increased leakage volume and thus power losses up to, as has been shown, 50%, leading to a correspondingly reduced cleaning efficiency in relation to the applied energy.

In order to compensate for the effective recoil force, three gap seals are provided, two of which are separated by leakage holes originating from the channel and a third leakage hole which is separated by the leakage chamber from the other two and is also provided between the nozzle holder and the main body. These gap seals are assigned to the high pressure area.

This likewise applies to a rotor nozzle known from U.S. Pat. No. 4,821,961 in which the leakage chamber changes into a radially aligned low-pressure gap, the height of which likewise changes depending on the axial movement of the nozzle holder due to recoil, wherein a leakage outlet is obtained which is proportional to the third power of the height of the low pressure gap. This causes an unstable compensation of the recoil forces, so that also this rotor nozzle is not suitable to meet the requirements set to the extent desired.

Another rotor nozzle is discussed in U.S. Pat. Appl. Pub. No. 2011/0108636 A1. A disadvantage of this known construction is firstly the arrangement of two leakage chambers, through which the leakage flow relevant for an axial bearing is divided.

This design is extremely complicated in terms of its implementation regarding manufacturing technology and therefore expensive.

Moreover, the leakage for the axial bearing is removed centrally from the sealing gap, which requires a large leakage, with a correspondingly high energy loss and a resulting poor efficiency of the rotor nozzle.

For the purpose of forming a throttle, transverse bores are provided, which open into an axial gap with outlet to the outside, starting from one of the leakage chambers. The throttle effect is achieved by a cross-sectional constriction of the inlet region of the transverse bore, when the nozzle holder moves axially, wherein the cross-sectional change of the transverse bores is effected by a part of the lateral surface of the nozzle holder. This non-linear throttle characteristic resulting from the change in the circular cross section of the transverse bore leads to a susceptibility to vibration and thus an unstable control behavior.

According to an illustrative embodiment of the present disclosure, as a result of the throttle gap adjoining the leakage chamber, which throttle gap encloses a partial area of the nozzle holder circumferentially with gap spacing, the volume flow of the high-pressure leakage, which is supplied via the gap seal to the leakage chamber, remains unchanged regardless of the axial position of the rotating nozzle holder.

In this case, the throttle gap forms a low pressure region, for example, with a pressure of about 20 bar, wherein a force balance occurs, depending on the fluid pressure, by a self-adjusting length of the throttle gap.

Irrespective of its length, the throttle gap may have a constant height, for which purpose the main body, just like the nozzle holder, which together radially delimit the throttle gap, have cylindrical lateral surfaces facing each other, namely the main body an inner and the nozzle holder an outer circumferential surface.

As a result of the axially acting recoil force of the fluid emerging from the nozzles, the nozzle holder is displaced axially in the direction of the leakage chamber, the contained leakage liquid of which practically forms an abutment and counteracts the recoil force.

Through the throttle gap, a pressure forms in the leakage chamber, which results from the leakage flowing through the associated gap seal into the leakage chamber and the gap height of the throttle gap and is linearly dependent on the mentioned variable length of the throttle gap, which ensures a stable adjustment behavior of the pressure. The volume flow of the high-pressure leakage escaping the gap seal is almost independent of the displacement position of the nozzle holder.

According to an embodiment of the disclosure, a braking device is arranged in the leakage chamber, which is part of the nozzle holder and which similar to a ship's propeller is formed as a fluid brake or alternatively as a magnetic brake.

As a result, a speed reduction of the nozzle holder is achieved, which leads to an increase in the dwell time of the fluid jet emerging from the nozzles and thus an improvement in the cleaning efficiency.

According to another embodiment of the disclosure, the high-pressure rotor nozzle has an outer sleeve, which is dimensioned in its axial extension so that it at least largely covers the gap seal which is associated with the nozzles, wherein a circumferential annular gap is formed, which communicates with the fluid-supplying channel likewise in a fluid-open manner as with the nozzles. This means that the fluid under high pressure is passed through the annular gap to the nozzles, wherein the supply of the fluid to the annular gap or from the annular gap to the nozzles takes place by introduced feed channels.

The effective pressure in the annular gap counteracts the internal pressure of the fluid guided in the associated gap seal, so that the gap seal remains unchanged in its dimension, i.e. it is not expanded, thus effectively preventing an increase in leakage outlet.

This structural design also offers manufacturing advantages, since above all the introduction of holes which are relatively long in relation to the diameter can be dispensed with, which naturally results in significant cost savings.

DETAILED DESCRIPTION OF THE DRAWINGS

Figure 1:
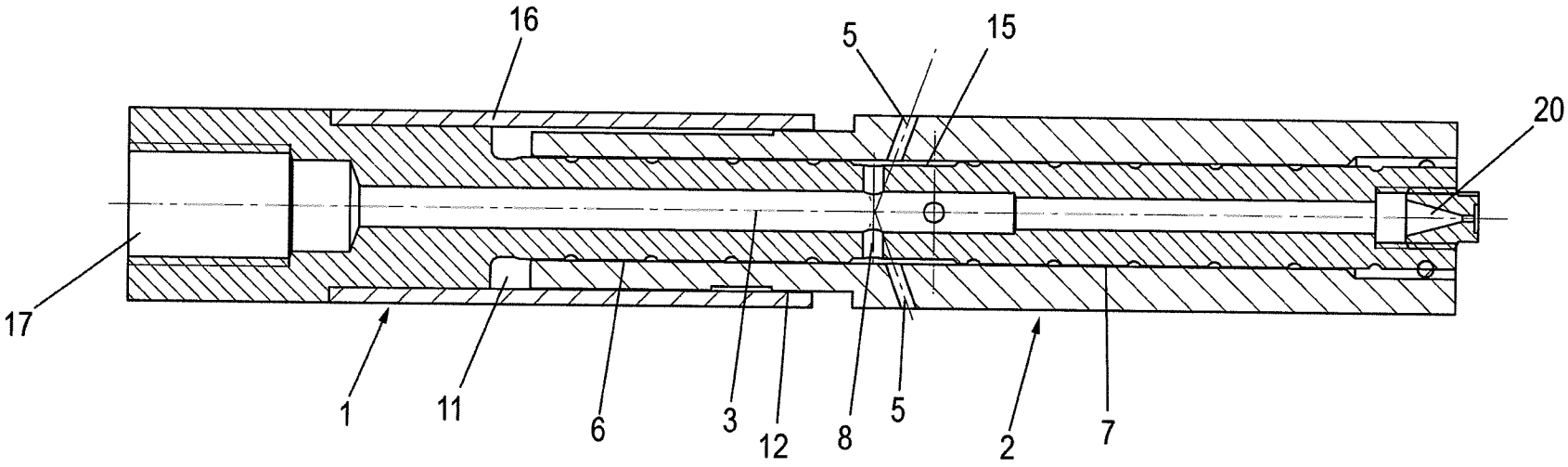
FIGS. 1 to 3 each show an exemplary embodiment of a high-pressure rotor nozzle according to the present disclosure in a longitudinal section.

FIG. 1 shows a high-pressure rotor nozzle which, in the simplest case, has laterally exiting radial nozzles 5 and optionally an axial nozzle 20.

In the basic structure, the rotor nozzle consists of a main body 1 and a nozzle holder 2 rotatably mounted therein, which can be driven by means of the radial nozzles 5 held therein.

In the main body 1, an axially extending centric channel 3 is introduced, which starts from a connection 17 and opens at the opposite side into the fixed axial nozzle 20 held in the main body 1.

Via the connection 17, liquid under high pressure (500-4000 bar) is guided into the channel 3, which has transverse bores 8, via which the liquid is led into a circumferential pocket 15 between the main body 1 and the nozzle holder 2 to the radial nozzles 5, which incidentally extend inclined to the axis of rotation of the nozzle holder 2 obliquely to the axial nozzle 20.

In the region facing the connection 17 between the main body 1 and the nozzle holder 2, starting from the pocket 15, a first gap seal 6 is formed, via which leakage water can be guided into a leakage chamber 11, while the opposite region adjoining the pocket 15 and associated with the axial nozzle 20 is formed as a second gap seal 7, wherein both gap seals 6, 7 form a high-pressure gap seal. The arrangement of the connection 17 can be seen as an example. It is also conceivable to provide positioning in any other suitable area, e.g. on the opposite side.

The leakage chamber 11, which forms an axial bearing in operation and is filled with the fluid entering through the first gap seal 6, changes into at least one throttle gap 12 which circumferentially encloses the nozzle holder 2 in a partial area, extends axially parallel to the channel 3 and is open to the atmosphere, wherein the fluid pressure is greatly reduced by the throttle gap 12.

In operation, a pressure is generated by the throttle gap 12 in the leakage chamber 11, which is dependent on the leakage amount penetrating through the first gap seal 6 into the leakage chamber 11, the constant height of the throttle gap 12 and its variable length.

The pressure built up in the leakage chamber 11 acts as a force against the nozzle holder 2 axially displaceable by recoil forces and presses said holder in a direction opposite to the connection 17. The further the nozzle holder 2 moves in this case, the shorter the length of the throttle gap 12 becomes, which in turn lowers the pressure in the leakage chamber 11 and thus reduces the force acting on the nozzle holder 2. This results in an automatic positioning of the nozzle holder 2 in the axial direction until the recoil force of the nozzles 5 and the leakage pressure prevailing in the leakage chamber 11 are in balance. The nozzle holder 2 then rotates as a low-friction axial bearing without contact on the water cushion formed in the leakage chamber 11.

Figure 2:
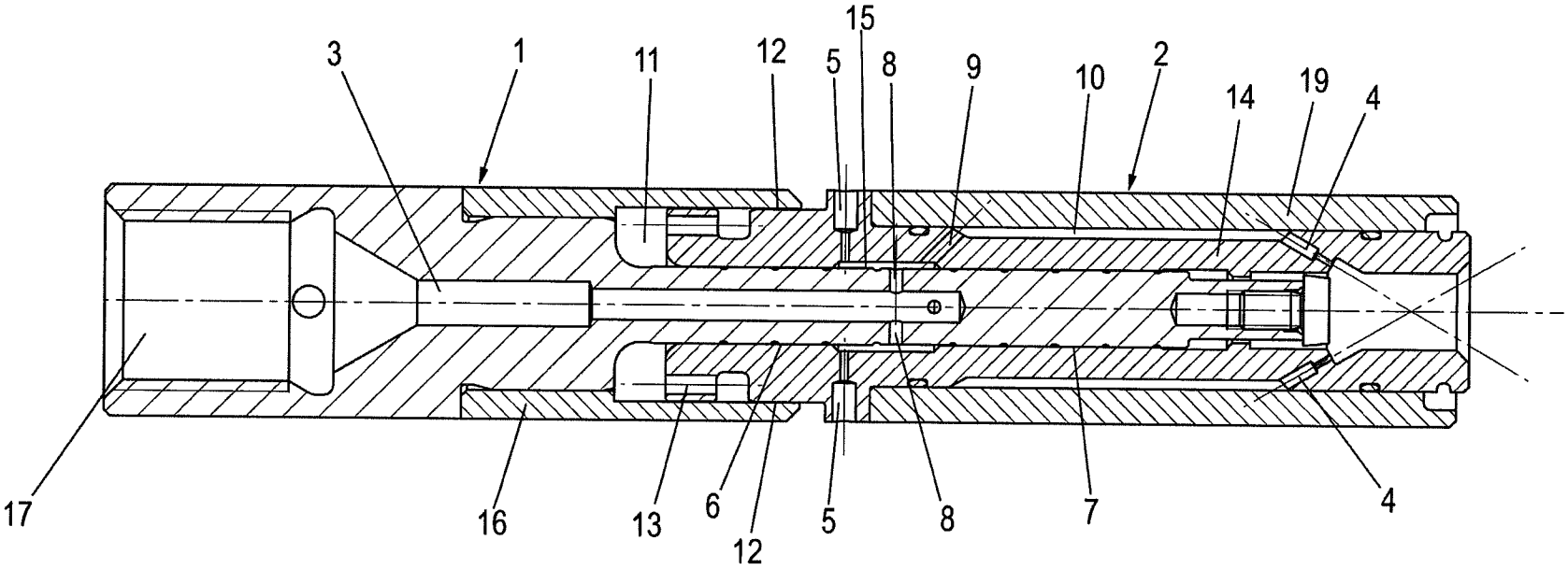

The high-pressure rotor nozzle also has the same function as in the exemplary embodiment shown in FIG. 2.

In this case, the nozzle holder 2 consists of an inner support sleeve 14 and an outer sleeve 19, between which an annular gap 10 is formed in the overlap region of the second gap seal 7, which is in connection with the pocket 15 in a liquid-open manner via feed channels 9.

At the opposite end of the annular gap 10, frontal nozzles 4 which extend inclined to the axis of rotation are provided in the nozzle holder 2, via which the fluid passed through the annular gap 10 emerges under high pressure, as well as from the radial nozzles 5, which also communicate with the pocket 15 and which simultaneously cause a rotation of the nozzle holder 2 due to the recoil forces.

Since the leakage fluid in the second gap seal 7 is approximately at the same pressure as the fluid guided in the annular gap 10, a back pressure is effective by means of which the expansion of the gap seal 7 is effectively prevented.

In the region of the leakage chamber 11, a braking device in the form of a fluid brake 13 is arranged, which is part of the nozzle holder 2 and which serves to reduce the rotational speed of the rotating nozzle holder 2, so as to achieve a more efficient cleaning effect.

In addition, for forming the throttle gap 12, the main body 1 comprises a circumferential jacket part 16 which is part of the main body 1 and whose inner circumferential jacket surface partially forms an outer boundary of the throttle gap 12 and the leakage chamber 11.

Figure 3:
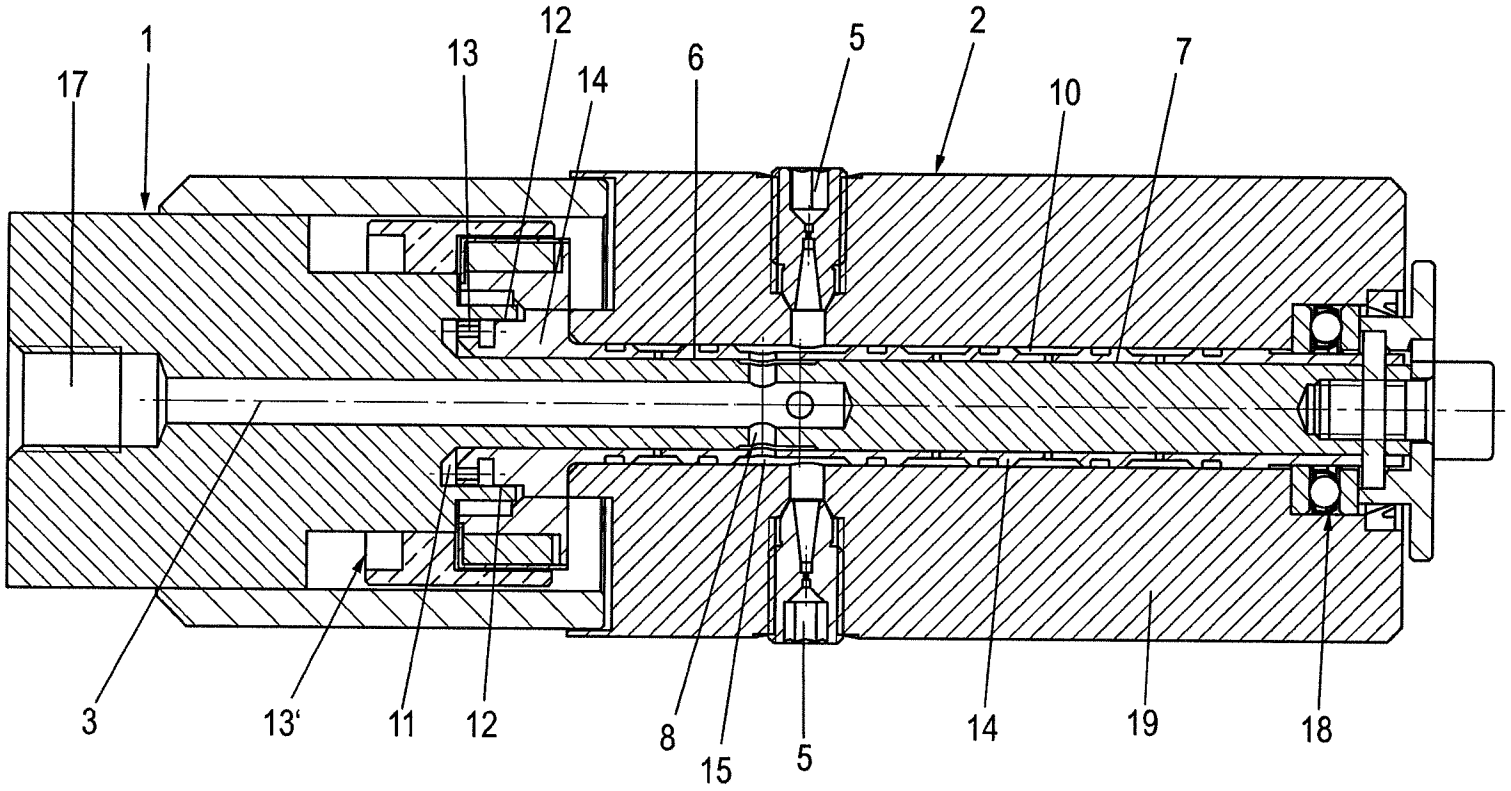

A further embodiment is shown in FIG. 3, in which, however, only radial nozzles 5 are used, while an axial bearing 18 for supporting the outer sleeve 19 is provided on the front side.

In this embodiment variant, instead of a fluid brake 13, a magnetic brake 13' can be provided for speed reduction of the nozzle holder 2, which is shown only for reasons of clarity.

The invention claimed is:

1. A high-pressure rotor nozzle, comprising:

a main body having a channel configured to supply a liquid under high pressure, and a nozzle holder rotatably drivable by a hydraulically generated torque and having at least one nozzle which is in connection in a liquid-open manner with the channel and causes an axial recoil in operation, wherein a leakage chamber forming a hydraulic axial bearing in operation is provided between the main body and the nozzle holder that can be axially adjusted in relation to the same in a recoil-dependent manner, with said leakage chamber being connected to a first gap seal, guiding a leakage fluid between the main body and the nozzle holder, wherein the leakage chamber changes into at least one throttle gap circumferentially surrounding the nozzle holder in an axial sub-region and varying in an axial extension thereof according to a movement path of the nozzle holder, wherein the throttle gap remains a same height over an axial length thereof;

wherein the nozzle holder includes a support sleeve and an outer sleeve encompassing and connected to the support sleeve, the support sleeve having an inner surface and an outer surface, and wherein a concentric annular gap is delimited by the outer surface of the support sleeve and the inner surface of the outer sleeve.

2. The high-pressure rotor nozzle of claim 1, wherein the at least one throttle gap is open to atmosphere.

3. The high-pressure rotor nozzle of claim 1, wherein the at least one throttle gap is formed between the main body and the nozzle holder.

4. The high-pressure rotor nozzle of claim 1, wherein the at least one throttle gap runs parallel to an axis of the channel.

5. The high-pressure rotor nozzle of claim 1, wherein the nozzle holder has a speed-reducing braking device.

6. The high-pressure rotor nozzle of claim 1, wherein a second gap seal is provided between the main body and the nozzle holder downstream of the first gap seal in an axial direction, starting from the leakage chamber, wherein between the two gap seals a pocket is formed, said pocket forming a pressure chamber and being liquid-open to the channel and into which at least one radial nozzle opens.

7. The high-pressure rotor nozzle of claim 6, wherein the concentric annular gap at least partially covers the second gap seal in the axial direction.

8. The high-pressure rotor nozzle of claim 7, wherein the concentric annular gap is in liquid-open communication on the one hand with the channel and on the other hand with the at least one nozzle.

9. The high-pressure rotor nozzle of claim 6, wherein the annular gap is connected via at least one feed channel to the channel.

10. The high-pressure rotor nozzle of claim 9, wherein the at least one feed channel and the at least one nozzle are arranged in the support sleeve.

11. The high-pressure rotor nozzle of claim 1, wherein mutually facing cylindrical surfaces of the nozzle holder and of the main body define the first gap seal.

12. The high-pressure rotor nozzle of claim 5 wherein the speed-reducing braking device is a fluid brake.

13. The high-pressure rotor nozzle of claim 5 wherein the speed-reducing braking device is a magnetic brake.

14. The high-pressure rotor nozzle of claim 6 wherein the pocket is circumferential.

* * * * *